United States Patent [19]

Paterson et al.

[11] Patent Number: 4,865,315

[45] Date of Patent: Sep. 12, 1989

[54] DEDICATED MICROPROCESSOR CONTROLLED EXERCISE RESISTANCE MACHINE

[75] Inventors: Doug F. Paterson; Martin DuPont, both of Boulder, Colo.

[73] Assignee: Universal Gym Equipment, Inc., Cedar Rapids, Iowa

[21] Appl. No.: 154,337

[22] Filed: Jun. 22, 1988

Related U.S. Application Data

[63] Continuation of Ser. No. 823,037, Jan. 27, 1986, abandoned.

[51] Int. Cl.[4] ..... A63B 21/00

[52] U.S. Cl. ..... 272/130

[58] Field of Search ..... 272/130

[56] References Cited

U.S. PATENT DOCUMENTS 4,705,271 11/1987 Mondloch et al. ..... 272/130
4,711,450 12/1987 McArthur ..... 272/130
4,722,525 2/1988 Brentham ..... 272/130

*Primary Examiner*—Leo P. Picard
*Attorney, Agent, or Firm*—Darby & Darby

[57] ABSTRACT

A hydraulic exercise machine which employs the use of a fluid actuator and a servo pump mechanism controlled by an integrated microprocessor device. The dedicated microprocessor control is pre-programmed to provide the user with three (or more) exercise modalities; a manual mode, in which the user independently selects the concentric and eccentric force values; a pyramid mode, in which the user selects an automatic increasing progression of concentric and eccentric force values, which upon user failure to complete a full repetition, automatically reverses the force value progression; and a maximum strength test or exercise program, in which the user applies maximal muscular force against the resistance in both the concentric and eccentric phase of the exercise. Various performance parameters are displayed and recorded in real time. The integrated microprocessor control device can be linked to external computer systems for unlimited programming of all known exercise functions in either an active or passive modality.

8 Claims, 6 Drawing Sheets

DEDICATED MICROPROCESSOR CONTROLLED EXERCISE RESISTANCE MACHINE

This is a continuation of Ser. No. 823037, filed 1/27/86, now abandoned.

FIELD OF INVENTION

This invention relates to a programmable exercise machine, and more specificaly, relates to a programmable active and/or passive exercise resistance device, with a plurality of operational modes.

BACKGROUND OF INVENTION

Exercise machines are well known, and many different designs have been previously suggested or developed, that employ the use of weights, pulleys, chains, cams, pneumatic, hydraulic, or electrical systems, to to transmit resistance, and facilitate exercise programs.

Prior existing exercise machines, which advanced the exercise art, particularly those that applied external microprocessors to control the exercise movement, relied on upon valves, regulators, and other structural differences to provide exercise resistance, control, and data feedback. For example, U.S. Pat. No. 4,354,676 to Ariel, 4,063,726 and 3,902,480 to Wilson, and 3,869,121 to Flavell.

These exercise devices provide only the means for passive resistance, and do not provide an active resistance modality, particularly in the negative (eccentric) phase of the exercise motion.

Further, these previously existing exercise machines do not provide a self-contained, internally integrated microprocessor control system for multi-mode exercise. Another distinct disadvantage of the prior art, is the lack of "user-friendliness" and an easy to use command input device, which distinctly limits the layman's use of these machines.

Thus, there is a need for an exercise machine that provides the user with any combination of active or passive resistance modalities, along with a simplified operational format.

Four general modes of exercise resistance have been recognized, and are incorporated into the design of the present invention. These modalities are: Isometric, isokine tic, isodynamic, and isotonic.

Isometric exercise resistance involves the musculr exertion of force against a stationary load, and allows for the maximum effort of a specific number of muscle fibers dedicated to a muscle joint angle. Since no motion occurs, the only by-product of this type of muscle contraction is heat.

In isokinetic exercise, the muscle exerts force against a load or resistance factor which follows a predetermined velocity pattern, independent of the force applied. Isokinetic exercise is considered to be the most likely accepted and safest form of exercise for rehabilitation. The isokinetic resistance form is a passive modality.

Isodynamic exercise is similar to isokinetic exercise since it is passive, and restricts the velocity of movement in proportion to muscular exertion. Isodynamic exercise allows acceleration(s) to maintain constant force.

Isotonic exercise allows the muscle to contract as it works against a fixed form of resistance or load. Isotonic muscle exercise is divided into two phases: 1. Positive (concentric) phase, involving the shortening of the muscle fibers. 2. Negative (eccentric) phase, involving the lengthing of the muscle fibers. Scientific research indicates that the negative phase is capable of greater muscular force, than the positive phase. Isotonic exercise can take both a passive and an active form.

By interfacing the microprocessor controlled electromechanical system described herein, to any given framing means, any combination of the four resistance modalities i.e., isometric, isokinentic, isodynaic, and isotonic, can be employed, including split-phase positive/-negative resistance loads.

With appropriate programming and sensing means, the microprocessor system can react to the position and forceof the user within microseconds, thereby allowing the use of any existing exercise modality, and to display any parameter of such exercise as bio-feedback to the user.

This integrated exercise machine offers a wide range of exercise modalities as well as a simplified means to implement such programs, and thereby insures the maximum efficiency and effectiveness of the exercise, along with optimum user motivation.

SUMMARY

In accordance with the invention claimed, an improved dedicated microprocessor controlled exercise mechanism is provided for supplying electronically controlled force values for both passive and/or active isometric, isokinetic, isodynamic, and isotonic exercise modalities.

It is therefore, one objective of this invention to provide an improved exercise machine, that can be active in nature, with an electronic control and feedback system, interfaced with a servo motor/pump assembly that drives and/or loads a hydraulic actuator.

Another objective of this invention is to provide an improved exercise machine that has multi-mode operational capabilities, which can be incorporated into any framework suitable for translating and supplying resistance for any reasonable muscular action, whether rotary, linear, lever, or cable actuated.

A further objective of this invention is to provide an improved exercise machine which has a simplified means for selection of multi-mode operations by the user, who, while in the exercise position, has easy access to a keyboard for program selection, force value setting, and an immediate display of exercise performance and bio-feedback.

A still further objective of this invention is to provide an improved exercise machine that allows the user to select from three electronic control programs:

1. a MANUAL selection isotonic exercise program, which allows the user to independently select the (passive) positive force values, and the (active) negative force values desired.

2. a PYRAMIDING mode, which allows the user to experience a isotonic (linear) progression of increased resistance for each repetition of exercise successfully completed, with an automatic reverse progression initiated when the user fails to complete a full repetition with the force in use.

3. a MAXIMUM effort strength test mode, which combines a passive positive phase with an active negative phase.

A still further objective of this invention is to provide the user with a selection of multiple resistances, velocities, and force profiles, from which the user may select the resistance profile most appropriate to the user's particular musculo-skeletal range of motion, strength, and/or personal preference.

A still further objective of this invention is to provide an improved exercise machine having a digital or video display which includes, a velocity of execution histo-bar, a scoring system that rates the relative efficiency of the user against the resistance of the machine, the peak force in use for both the positive and negative phase of exercise, and the elapsed time of use.

A still further objective of this invention is to provide an improved exercise machine having a readily adjustable hydraulic seat or support configuration, which the user may set at any position within the range of motion of the device.

A still further objective of this invention is to provide an improved protective padding system for the user which incorporates the use of high density cellular foam laminated with a surface of urethane elastomeric film.

Further objects and advantages of the invention will become apparent as the following description proceeds and the features of the novelty which characterizes the invention are pointed out, and in particular, the claims annexed to and forming a part of this specification.

BRIEF DESCRIPTION OF THE DRAWINGS

The present invention may be readily described by reference to the accompanying drawing, in which.

DESCRIPTION OF THE PREFERRED EMBODIMENT

Figure 1:
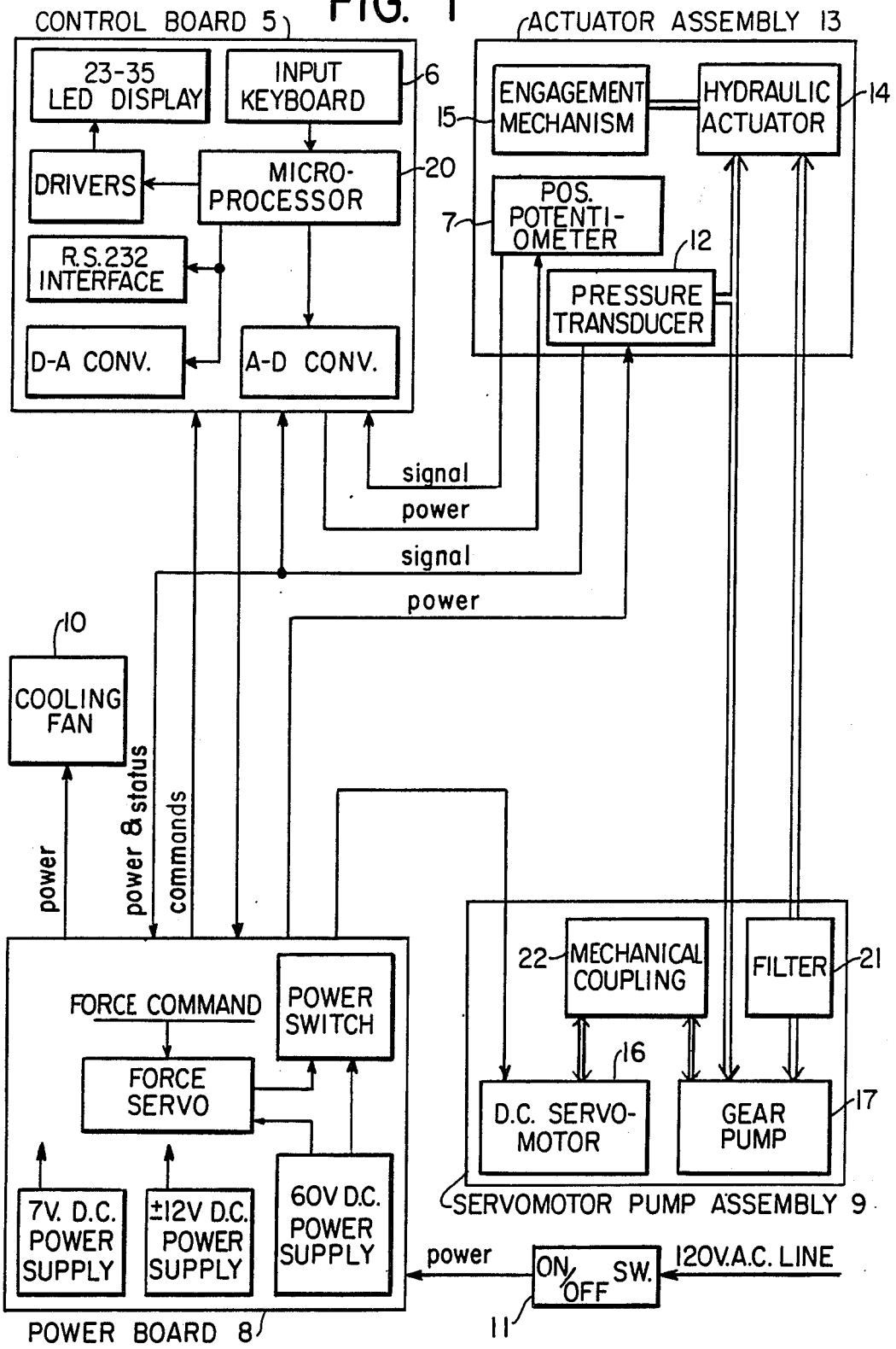
FIG. 1 is a block diagram illustrating the overview of the exercise resistance system.
Figure 4:
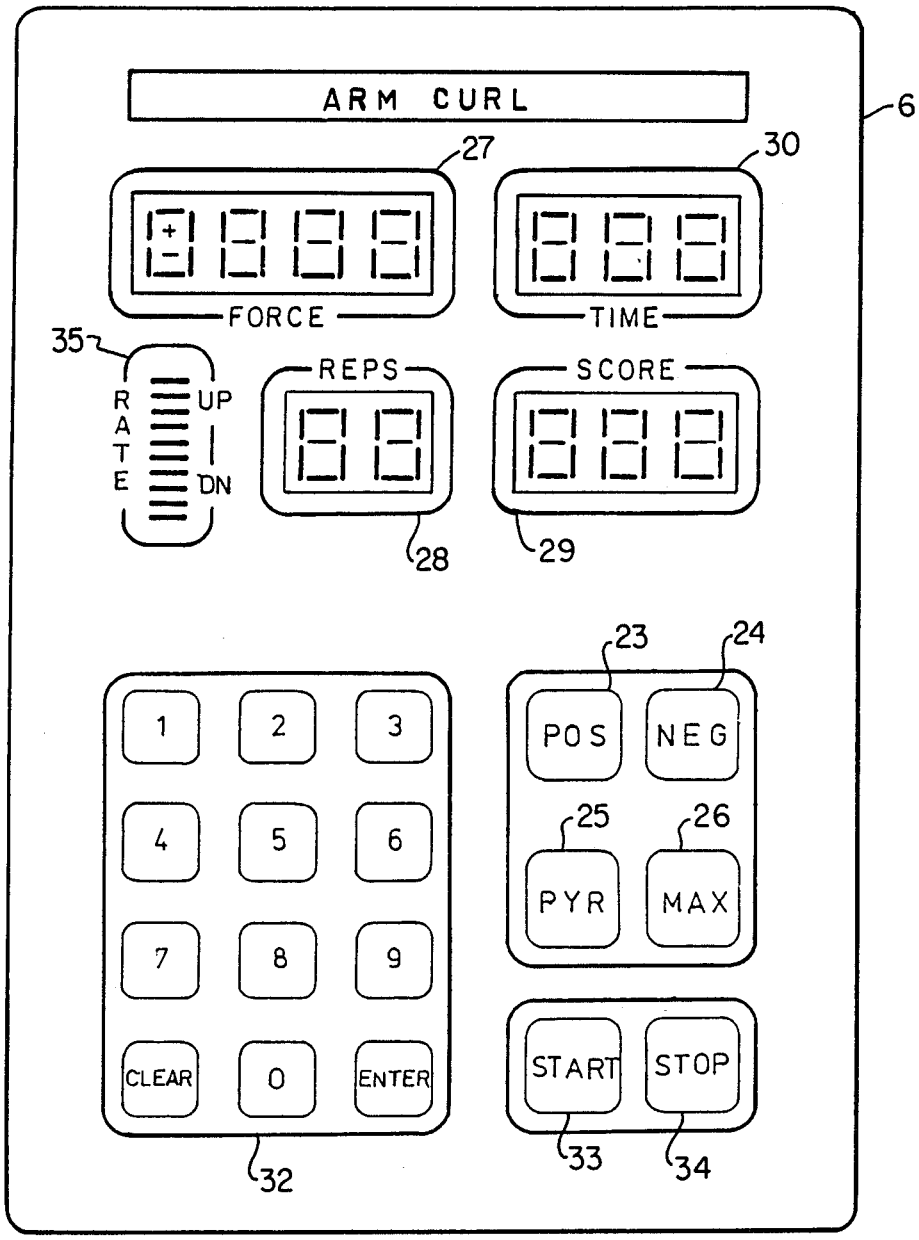
FIG. 4 is a perspective with cut-away views of a selected frame engagement means with the control system, servomotor/pump, and actuating assemblies.

Referring more particularly to the drawing by characters of referrence, as depicted in FIG. 1 and FIG. 4, this invention is designed as a stand-alone integrated exercise unit, with easy user access to the engagement means.

The embodiment mechanism of choice, shown in FIG. 4, is an arm curl exercise device 2, which also depicts the pneumatic spring and gravity driven seat 3, and the high density urethane protective padding system 4.

Figure 5:
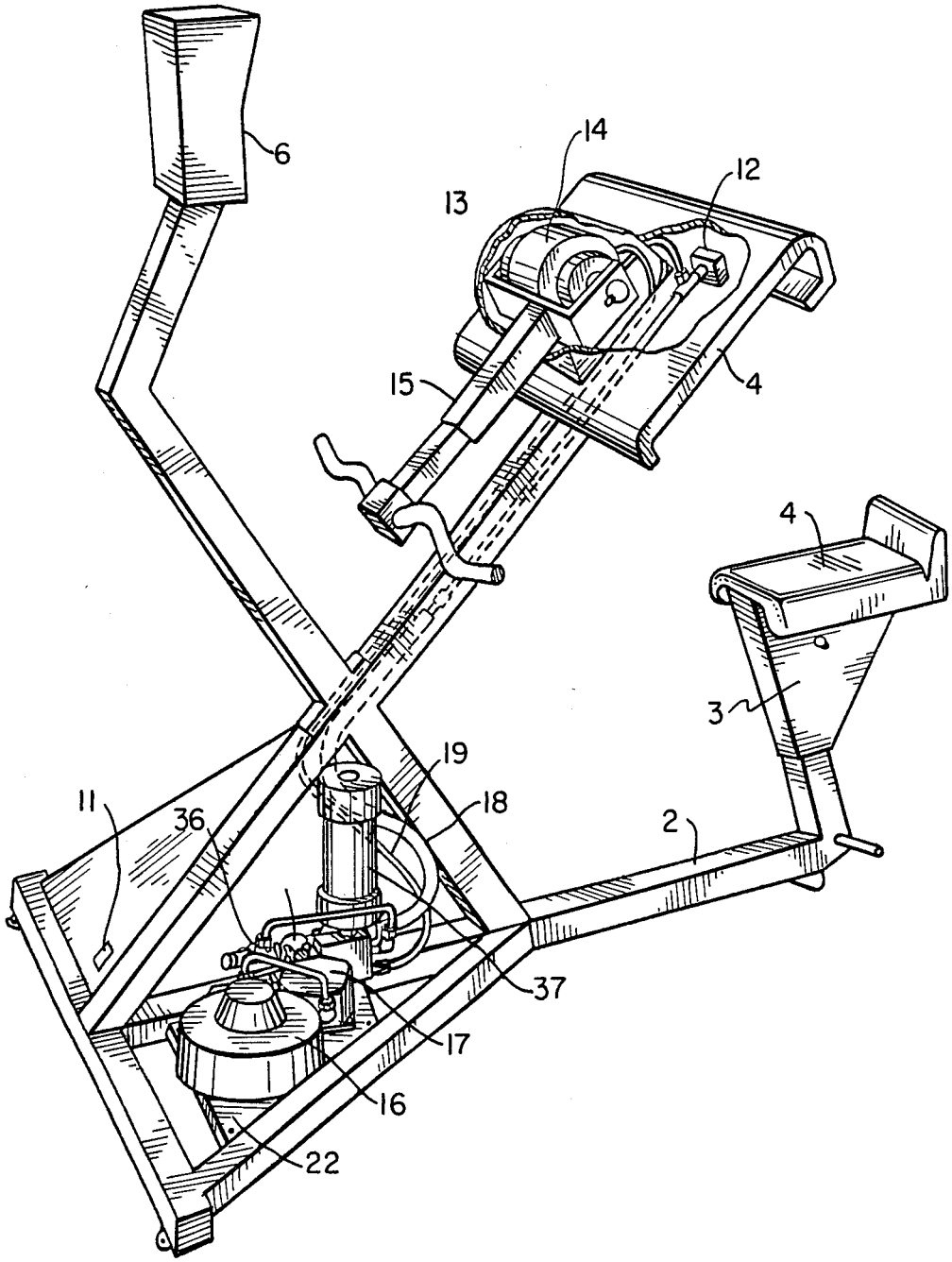
FIG. 5 is a detail of the control panel's LED display/input keyboard.

FIG. 1 discloses an exercise resistance system comprised of a key board/LED display 6, detailed in FIG. 5, coupled to a dedicated microprocessor control board 5, which receives input from the position potentiometer 7, (amongst other sources), and modulates the power from the direct current transformer power board 8, (cooled by cooling fan 10), to the servo-motor pump assembly 9. An on-off switch 11, transfers power from the incoming 110 volt A.C. line to the power board 8.

The system pressure (force) signal is transmitted to the control board 5, from the pressure transducer 12, via the power board. The pressure transducer 12, is positioned within the pressure loop of the hydraulic system, as detailed in FIG. 2.

Figure 2:
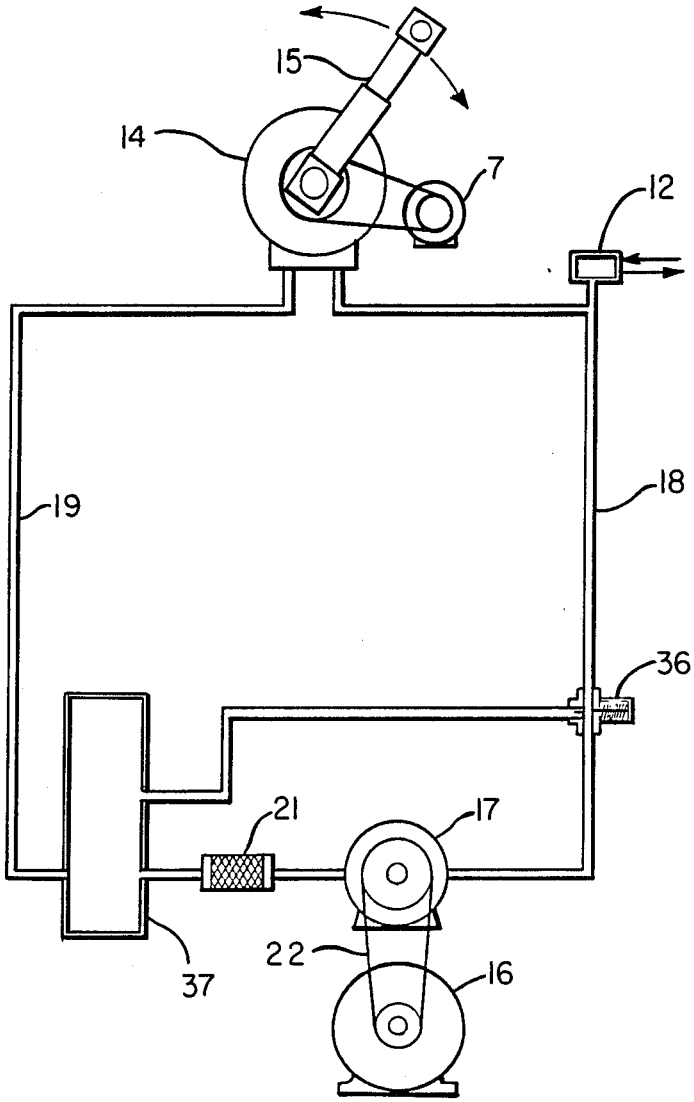
FIG. 2 is a schematic diagram showing the components of the hydraulic circuit.

A position potentiometer 7, used to indicate the exact position of the user engagement mechanism 15, as detailed in FIG. 2, is coupled to the fluid hydraulic actuator 14. The user engagement mechanism 15 is coupled directly to the fluid hydraulic actuator 14.

The valveless hydraulic system is composed of a servo-motor 16 linked to gear pump 17 via transmission 22, as shown in FIG. 2, (used for both power and load), with high pressure driving fluid line 18, and low pressure take-up fluid line 19, plumbed to and from, the fluid hydraulic acturator 14, with safety relief valve 36 returning to the fluid reservior 37, and a filter 21, plumbed on the intake side of the pump 17.

Figure 3:
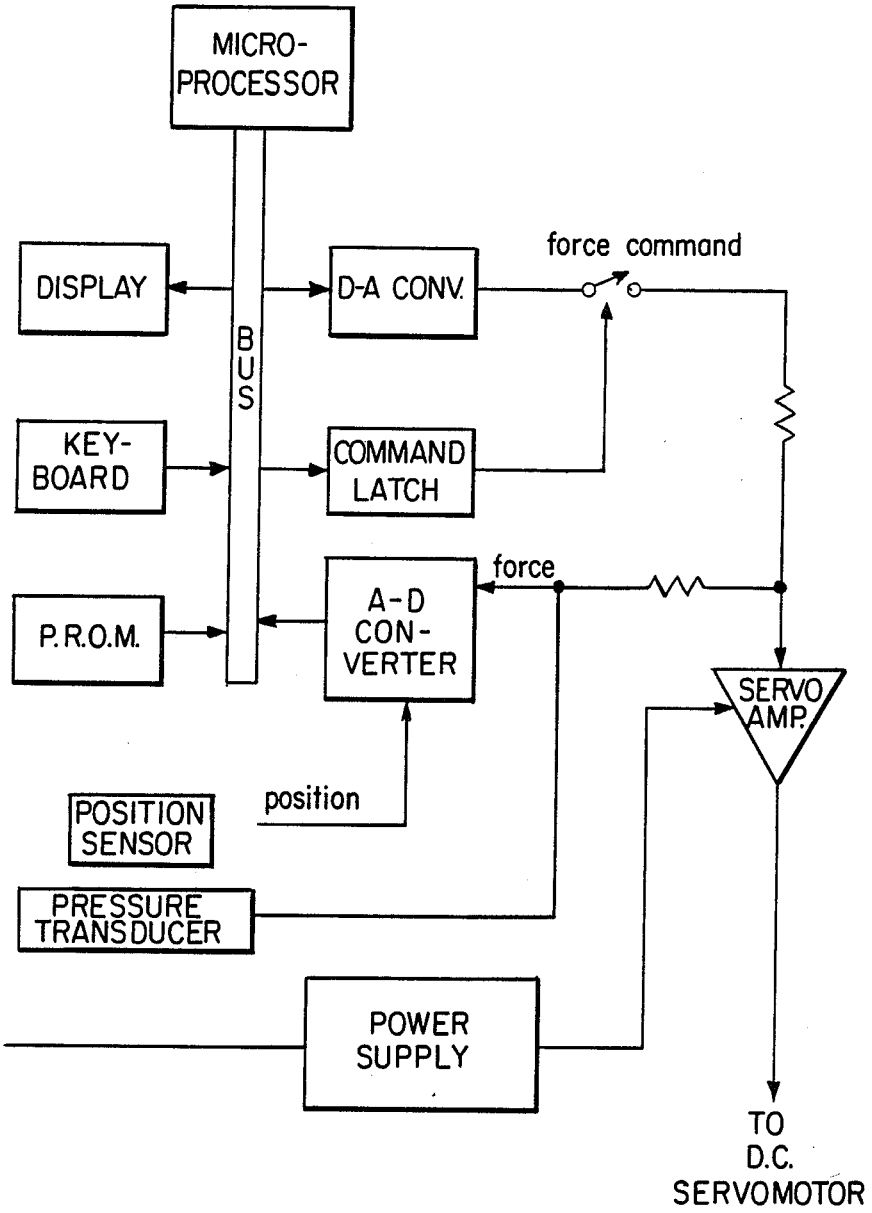
FIG. 3 is a schematic diagram of the wiring assembly, input signal means, and control system.

Power to the servo-motor gear pump assembly 9, is directed and controlled by the microprocessor means 20, mounted on control board 5, as shown in FIG. 1. The electronic control logic diagram, FIG. 3, schematically illustrates the electronic interface.

During the user's positive phase of motion, power is controlled and directed to maintain the proper resistance and force profile. The servo motor/pump assembly 9, actively loads or unloads the actuator 14, as necessary.

At the end of the user's positive phase of motion, new commands for force, velocity, position, and force profile, are issued from the control board 5. These commands instruct the power board 8 to provide the power required to activate the servomotor-pump 9, to drive actuator 14, which allows the user to perform the negative phase of the exercise.

FIG. 4 represents a semi-detailed view of the servomotor gear pump assembly 9, and its related hydraulic components, 17, 21, 22, 36, 37, linked to the user engagement lever 15, through the fluid actuator assembly 13, as applied to the selected exercise machine.

FIG. 5 illustrates the data input and LED display 6. The user may select one of three exercise or test modalities by pressing the desired program keys, 23,24,25,26. Numeric input keys 32, allow the user to select the desired amount of peak exercise resistance for the exercise modes.

The user can select a manual mode of isotonic exercise, in which both the peak positive (concentric) force value and the peak negative (eccentric) force value may be independently selected by the user.

To activate the manual selection mode, the user presses the POS key 23, then enters the amount of peak positive force desired, by pressing the appropriate numeric keys 32. The user then presses the NEG key 24, and enters the amount of peak negative force desired, by pressing the appropriate numeric keys 32. To initiate the program the user presses START button 33, and begins the positive/negative exercise cycle.

During the performance of the exercise, a histo-bar 35, labeled RATE, indicates the users actual rate of velocity relative to the pre-established proper velocity of execution as determined by the microprocessor 20.

Total time elapsed during the exercise is shown on TIME display 30.

The number of repetitions completed is shown on REPS display 28.

The user's performance score is shown by the SCORE display 29. The performance score is a measure of the user's proficiency during the exercise cycle in relation to the pre-programmed velocity of execution parameters, and cumulatively increases with each repetition.

Another exercise modality is the PYRAMID program, which is initiated by pressing the PYR key 25, and entering the initial peak resistance force desired using the numerical key pad 32. The user then presses the START key 33 to begin the exercise program. With each fully completed repetition, the peak positive force value increases in progressive steps for each succeeding repetition. This increasing progression continues until the user fails to complete a full repetition, at which point, a descending progression of peak force vales occurs.

During the pyramiding modality, the negative force values are always proportionately greater than the positive force values by a pre-selected factor, dictated by the microprocessor 20, for each repetition. The peak positive and negative force value for each repetition is displayed on the digital FORCE display 27. The number of repetitions, the score, and user's rate of motion, are also displayed for the pyramid mode as they were in the manual mode.

The user can select a maximal force exercise, or test modality, by pressing the MAX key 26. The user then presses the START key 33, to begin the exercise or strength test program. This instructs the machine to accept the user's positive force against lever 15 and to control the angular velocity of this lever to a pre-selected rate. This positive phase of the maximal cycle, is the isokinetic and/or isodynamic phase.

When the full excursion of the lever 15 is reached, the negative phase of the maximal mode cycle is immediately initiated. The user must then resist the negative (active) motion of the machine, which is pre-programmed to return the lever 15, to its initial starting position at a pre-selected angular velocity regardless of user force.

The peak positive and negative force values generated in the maximal exercise/test mode, are stored by the microprocessor 20, for later recall. These values may be retrieved by toggling the MAX key 26, which alternately displays the peak positive and negative force values on the FORCE display 27.

The exercise resistance system herein detailed can be incorporated into any suitable framework, such as illustrated in FIGS. 6A through 6F, which allows the user to engage the mechanism for the exercise of a given muscle group.

Figure 6A:
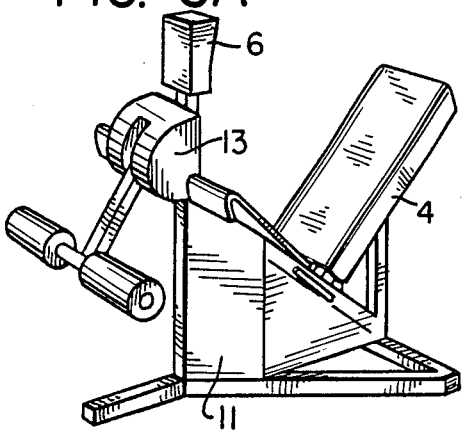
FIGS. 6A–6F are views of several exercise machines to which the control system has been applied.
Figure 6B:
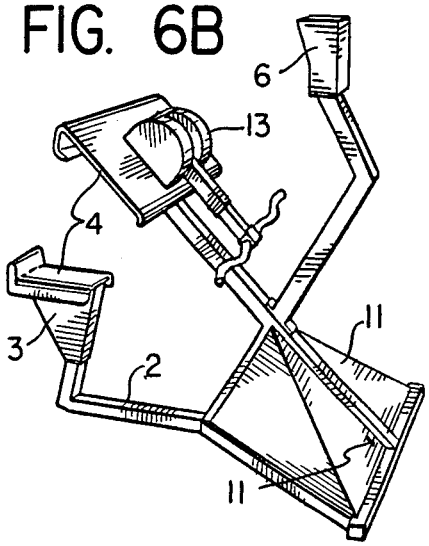
Figure 6C:
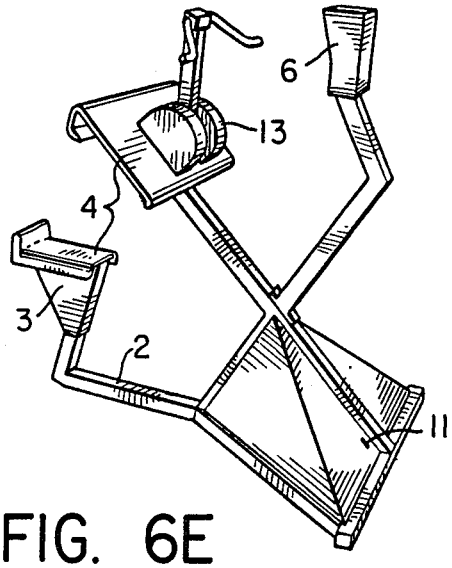
Figure 6D:
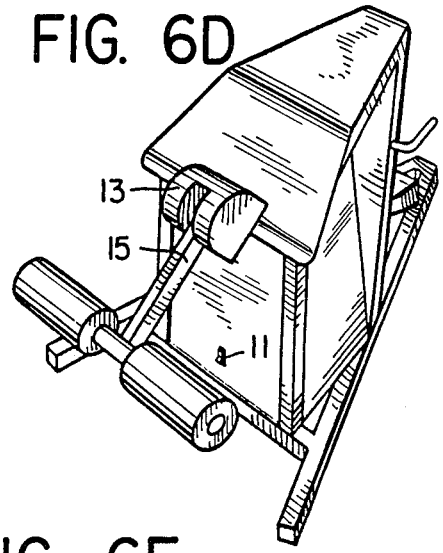
Figure 6E:
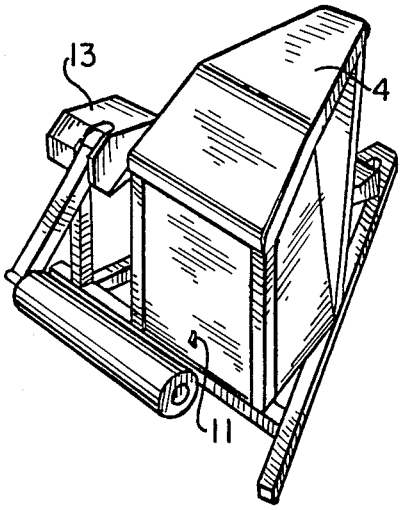
Figure 6F:
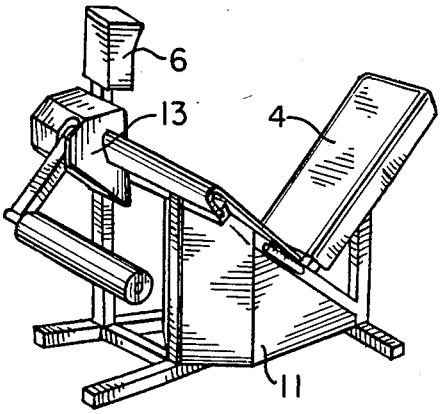

FIG. 6A illustratesa leg extension machine, FIG. 6B illustrates an arm curl machine, FIG. 6C illustrates a triceps machine, FIG. 6D illustrates a leg curl machine, FIG. 6E illustrates a side mount leg curl machine, and FIG. 6F illustrates a side mount leg extension machine.

What is claimed is:

1. A programmable exercise machine comprising:

engagement means having at least one degree of bi-directional freedom throughout a range of motion and contacting a body part of a machine user for at least one of: (i) resisting a user exerted positive force applied to move said engagement means in a concentric excursion and (ii) delivering a negative force to said engagement means to move it in an eccentric excursion against a resistive force exerted by the user's body part;

programmable means for controlling the position of occurrence of each of said positive and negative forces produced by said powering means and the magnitude thereof at each position of occurrence throughout said prescribed range of motion of said engagement means;

powering means coupled to said engagement means for at least one of: (1) providing a positive resistive force to said engagement means in opposition to a force exerted thereon by the user to move said engagement means in a concentric excursion of said engagement means and (ii) supplying a negative resistive force to move said engagement means to exert a force against the user's body part in an eccentric excursion throughout a prescribed range of motion of said engagement means; and said powering means including a hydraulic actuator coupled to said engagement means, fluid providing means responsive to said programmable means for controlling the delivery of fluid from and to said hydraulic actuator to provide the positive and negative forces to said engagement means, and a fluid connection between said hydraulic actuator and said fluid providing means which is free of valves that affect the fluid flow through said connection.

2. The machine of claim 1 wherein said engagement means is actuated by a lever means.

3. The machine of claim 1 wherein said engagement means is actuated by a flexible drive means.

4. The exercise machine of claim 1 wherein said means for controlling the delivery of fluid to said hydraulic actuator comprises servo-motor means, and inlet and outlet conduits coupled between said actuator means and said servo-motor means in a closed loop without valves.

5. The machine of claim 1 wherein said engagement means further comprises an independently actuated seating means having means for providing within its range of travel an infinite selection of seating positions, wherein the seating means is comprised of a linear hydraulic actuator reciprocally driven by an air-spring reservoir working against the weight of the user sitting on the seating means, and user control of said seat means in via a manual valve.

6. The machine of claim 1 further comprising protection means for all user contact surfaces which is comprised of a high density cellular foam that is externally laminated on its surface with a urethane elastomeric film.

7. The machine of claim 1 wherein said fluid delivery controlling means comprises servo-motor means, the user exerting force against said engagement means moving the relative position of the hydraulic actuator to drive fluid through the servo-motor means.

8. The exercise machine of claim 1 wherein said engagement means is free to produce bi-directional angular motion on at least one axis.

* * * * *